United States Patent [19]

Aboud

[11] Patent Number: 4,511,049

[45] Date of Patent: Apr. 16, 1985

[54] SAFETY CLOSURE AND CONTAINER

[76] Inventor: Fred G. Aboud, 3812 Taylorsville Rd., Louisville, Ky. 40220

[21] Appl. No.: 591,052

[22] Filed: Mar. 19, 1984

[51] Int. Cl.[3] ..... B65D 55/02

[52] U.S. Cl. ..... 215/216; 215/218

[58] Field of Search ..... 215/216, 217, 218

[56] References Cited

U.S. PATENT DOCUMENTS 3,399,796 9/1968 Steiner ..... 215/216

4,213,534 7/1980 Montgomery ..... 215/216

*Primary Examiner*—George T. Hall

*Attorney, Agent, or Firm*—Jon C. Winger

[57] ABSTRACT

A safety closure and container which is childproof, but can be readily opened by an adult. The container has a cylindrical neck defining the opening into the container. Threads are formed in the container neck and at least one locking lug projects from the container neck below the threaded portion. The closure has an internally threaded cylindrical flange adapted to be threaded on the container neck, and a second cylindrical flange having a larger diameter than the threaded flange. At least one resiliently mounted lug engagement finger projects inwardly from the second cylindrical flange and is adapted to abut the locking lug when the closure is in place over the container neck to prevent the unthreading of the closure from the neck. A lever associated with the resiliently mounted finger is depressed to displace the finger out of abutment with the locking lug thereby allowing the closure to be unthreaded from the container neck.

19 Claims, 5 Drawing Figures

SAFETY CLOSURE AND CONTAINER

FIELD OF THE INVENTION

The present invention relates generally to container closures and, more particularly, to a childproof container closure assembly which is adapted to be used on glass, metal or plastic bottles, or containers.

BACKGROUND OF THE INVENTION

A major concern in the packaging of potentially harmful medication is the provision of container closures which provide acceptable seals and are childproof. Childproof closures are those which cannot be opened by young children and cannot be easily opened by older children.

A number of bottle closure structures have been introduced in recent years which employ various means of preventing a young child from easily opening the cap, but all of these childproof closures are subject to some criticism or fault.

One approach to a childproof closure is found in U.S. Pat. No. 4,106,651. This patent discloses a safety closure assembly in which a cap, threaded onto the neck of a container, is provided with a hinged flap having locking means which engage corresponding locking means formed on the container neck. The hinged flap is pivoted in a plane parallel to the plane of the container mouth such that engagement of the locking means prevents rotation of the cap thereby locking it in position on the container. This design is relatively expensive to manufacture and assemble since accurately aligned screw threads are required both on the container and cap to assure that the locking means on the cap aligns with the corresponding locking means on the container neck when the cap is fully tightened.

Another approach to a childproof closure is disclosed in U.S. Pat. No. Re. 29,793 which has a hinged cap adapted to close an opening in the top of a container. The cap is hinged to the closure and includes a locking flap engageable with an outwardly extending projection formed on a sidewall of the closure neck. The locking flap is pivoted in a plane perpendicular to the plane of the container mouth so as to prohibit upward motion and opening of the cap without first disengaging the locking flap from the projection. Such disengagement is accomplished by depressing the resilient cap against a center pivot, and because of the resiliency of the cap, thereby separating the flap from the projection on the container.

It is an object of the present invention to provide a childproof closure having an improved locking mechanism which is less subject to being opened by small children than the prior art.

It is a further object of the present invention to provide childproof closure which may be sealingly screwed onto a container.

It is still a further object of the present invention to provide a childproof closure which can be readily opened by an adult.

It is an even further object of the present invention to provide a childproof closure which can be readily opened by an adult without having to exert a physical effort or force, and which therefore, can be opened by an adult having an physical infirmity such as, for example, arthritis.

SUMMARY OF THE INVENTION

The present invention, in particularly, provides a safety closure and container, the safety closure for sealingly closing the opening into the container, comprising the container having a generally cylindrical neck defining the opening into the container, threads formed in the outer peripheral surface of the container neck, at least one locking lug projecting generally radially outwardly from the container neck, the locking lug being located below the threads on the container neck, the closure having a first generally cylindrical flange of a diameter larger than the diameter of the container neck, threads formed in the inner peripheral surface of the closure first flange adapted to threadably engage the threads of the container neck, the closure having a second generally cylindrical flange of a diameter larger than the diameter of the container neck by an amount at least equal to twice the distance by which the locking lug projects radially from the container neck, at least one lug engagement finger projecting generally radially inwardly from the second closure flange, the engagement finger being adapted to abut the locking lug when the closure is threaded in place over the enclosure, means for resiliently mounting the engagement finger to the second closure flange, and means associated with the resilient mounting means for selectively displacing the enegagement finger out of abutment with the locking lug thereby allowing the closure to be unthreaded from the container neck.

DESCRIPTION OF THE DRAWINGS

The various objects and advantages of the present invention will become even more clear upon reference to the following discussion in conjunction with the accompanying drawings in which like numerals refer to like parts and wherein.

DETAILED DESCRIPTION OF THE INVENTION

Figure 1:
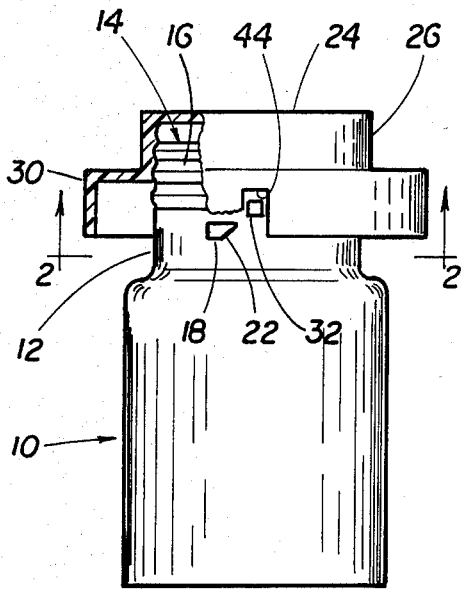
FIG. 1 is a cross-sectional side view of the bottle closure of the invention in a closed locked position on a container.
Figure 3:
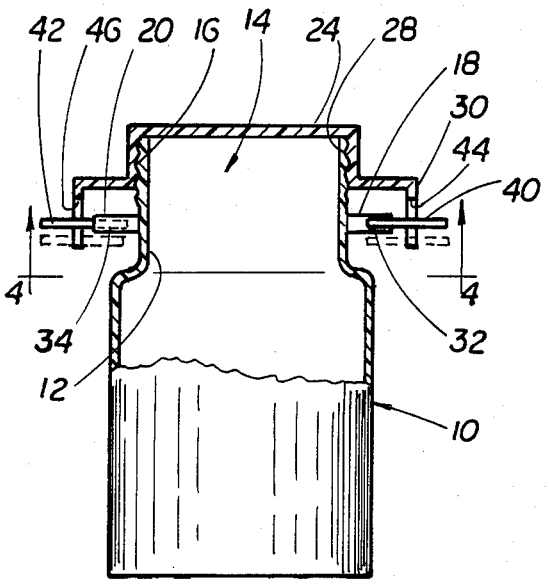
FIG. 3 is a cross-sectional side view similar to the view of FIG. 1, but showing the bottle closure in the unlocked position.

With reference to FIGS. 1 and 3, there is shown a container of the present invention generally denoted as the numeral 10. The container 10 includes a generally cylindrical neck 12 defining an opening 14 into the interior of the container 10. The container neck 12 has threads 16 formed in its outer peripheral surface. Two locking lugs 18 and 20 project generally radially outwardly from the container neck 12. The locking lugs 18 and 20 are preferably located below the threaded portion 16 of the container neck 12, and are spaced apart from each other circumferentially of the container neck 12. Preferably, the locking lugs are spaced apart through an arc of about 180 degrees so that the lugs 18 and 20 are diametrically opposed. In addition, as shown, each bottom side 22 of each lug is angled or sloped upwardly to create a caming surface. The locking lugs are shown as being integrally formed with the container neck 12 and are of substantially rigid construction.

Figure 2:
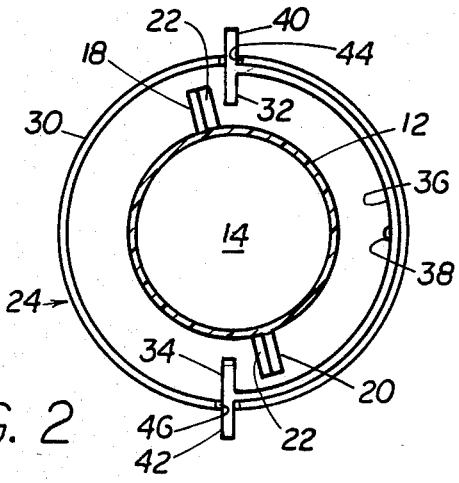
FIG. 2 is a cross-sectional top view taken in the direction of arrows 2—2 in FIG. 1.
Figure 4:
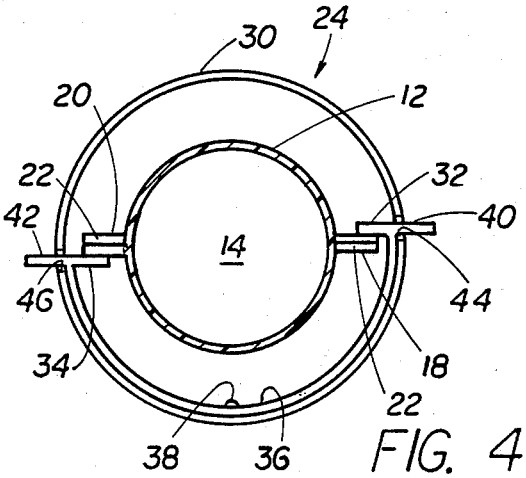
FIG. 4 is a cross-sectional top view taken in the direction of arrows 4—4 in FIG. 3; and, FIG. 5 is a bottom view of the closure of the present invention.
Figure 5:
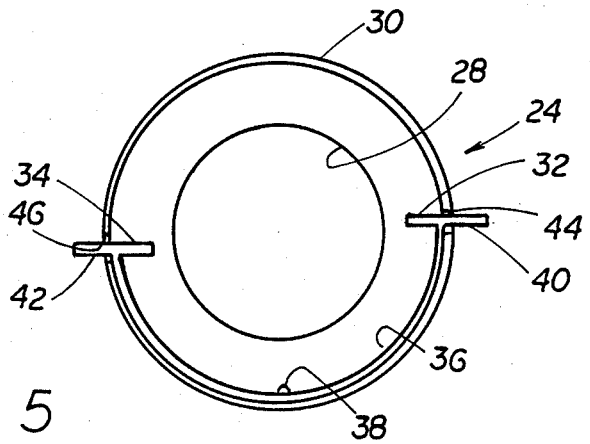

With continued reference to FIGS. 1 and 3, and additional reference to FIGS. 2, 4 and 5, there is illustrated a container closure or cap 24 of the present invention. The cap 24 includes a first depending cylindrical flange 26 having a diameter somewhat larger than the diameter of the container neck 12. Threads 28 are formed in the inner peripheral surface of the closure first flange 26 which are adapted to threadably engage or mate with the container neck threads 16 to sealingly fasten the closure 24 over the container neck 12 to close the opening 14 into the container 10.

The closure 24 further includes a second depending cylindrical flange 30 concentric with the first flange 26. The second flange 30 has a diameter larger than the diameter of the container neck 12 by an amount at least equal to twice the distance by which one of the locking lugs 18 and 20 projects radially from the container neck 12. In other words, as shown, the diameter of the second cylindrical flange 30 is at least equal to the distance between the free ends of the diametrically disposed locking lugs 18 and 20. The depth of the second flange 30 is greater than the distance from the free edge of the container neck 12 to the bottom side 22 of the locking lugs 18 and 20 so that when the closure 24 is threaded down in place over the container neck 12, the second flange extends downwardly at least to a position at, and preferably below, the bottom side 22 of the locking lugs 18 and 20.

The closure 24 also includes two lug engagement fingers 32 and 34 generally radially projecting inwardly of the closure 24 from the second cylindrical flange 30. The fingers 32 and 34 project radially inwardly from the second flange 30 by a sufficient distance so that when the closure 24 is threaded over the container neck 12, each finger 32 and 34 will be in generally parallel overlaying relationship to a different one of the locking lugs 18 and 20. For example, as shown, each finger 32 and 34 is about as long as one of the locking lugs 18 and 20. The lug engagement fingers 32 and 34 are spaced apart from each other circumferentially of the cylindrical flange 30 by an arc substantially equal to the arc separating the locking lugs 18 and 20 about the circumference of the container neck 12. As shown, the arc separating the lug engagement finger 32 and 34 is generally 180 degrees so that the engagement fingers 32 and 34 are diametrically opposed about the circumference of the second flange 30. The lug engagement fingers 32 and 34 are resiliently attached to the second closure flange 30 so that they can be resiliently displaced in a direction generally perpendicular to the plane of the locking lugs 18 and 20. This resilient attachment means comprises an arcuate resilient strap 36 interconnecting the lug engagement fingers 32 and 34. The radius of the strap 36 is generally equal to the radius of the second closure flange 30, and is located in overlaying relationship to the inner peripheral surface of the second flange 30. The lug engagement fingers 32 and 34 are shown as being integrally formed with the strap 36 at the opposite ends of the strap 36. Further, the strap 36 is attached between its ends to the inner peripheral surface of the second flange 30 as indicated by the numeral 38. The means of attachment can be by for example, a rivet, staple or glue. The lug engagement fingers 32 and 34 are selectively displaceable downwardly to a position below the bottom side of the locking lugs 18 and 20 by means of, as shown, cantilevered finger actuated levers 40 and 42. One lever 40 is attached to the strap 36 proximate one strap end and the other finger lever 42 is attached to the strap 36 proximate the other strap end. The levers 38 and 40 extend from the convex side of the strap 36 in a generally radial direction of the strap 36 through appropriate slits 44 and 46, respectively, formed through the second closure flange 30 such that the free ends of the levers 40 and 42 project outwardly from the outer peripheral surface of the second closure flange 30.

In operation, as the closure 24 is screwed down over the container neck 12 by turning the closure 24 in a clockwise direction as illustrated, the bottom sides 22 of the locking lugs 18 and 20 contact the engagement fingers 32 and 34 and function as cam surfaces to displace the fingers 32 and 34 downwardly so that the locking lugs 18 and 20 can pass the engagement fingers allowing the closure 24 to be threaded all the way down into sealing position. Due to the resilient mounting of the engagement fingers 32 and 34, after the locking lugs 18 and 20 pass the fingers 32 and 34, the fingers 32 and 34 resume their normal position extending from the second flange 32. When the closure 24 is in the final sealed position over the container neck 12, the lug engagement fingers 32 and 34 are each in overlaying, abutting, interfering relationship with a different one of the locking lugs 18 and 20 as can be best seen in FIG. 2. That is, one locking lug 18 is disposed in overlapping, abutting relation to enngagement finger 32 to one side thereof, for example, the side of the finger 32 adjacent the arcuate strap 36, and the other locking lug 20 is disposed in overlaying, abutting relation to the other engagement finger 34 to one side thereof, for example, the side of the finger 34 away from the arcuate strap 36. In other words, the locking lugs 18 and 20 contact the opposite sides, relative to the connection of the strap 36 to the fingers 32 and 34, of the respective lug engagement fingers 32 and 34. Therefore, the closure 24 can not be turned in the unthreading direction, counter-clockwise as shown in FIG. 2, because the fingers 32 and 34 physically interfere with the locking lugs 18 and 20.

In order to turn the closure 24 counter-clockwise, thus, unthreading the closure 24 from the container neck 12, the fingers 32 and 34 must be displaced out of the way, i.e., out of abutting relationship with the locking lugs 18 and 20. To accomplish this, one merely depresses the finger actuated levers 40 and 42, thus, displacing the fingers 32 and 34 downwardly until they are at a position below the bottom side 22 of the locking lugs 18 and 20 whereat, upon turning the closure 24 in an unthreading (counter-clockwise) direction, the locking lugs 18 and 20 clear and are allowed to pass the fingers 32 and 34.

The foregoing detailed description is given primarily for clearness of understanding and no unnecessary limitations are to be understood therefrom for modifications will become known to those skilled in the art upon reading this disclosure and may be made without departing from the spirit of the invention and scope of the appended claims.

What is claimed is:

1. A safety closure and container, the safety closure for sealingly closing the opening into the container, comprising:

the container having a generally cylindrical neck defining the opening into the container;

threads formed in the outer peripheral surface of the container neck;

at least one locking lug projecting generally radially outwardly from the container neck, the locking lug being located below the threads on the container neck;

the closure having a first generally cylindrical flange of a diameter larger than the diameter of the container neck;

threads formed in the inner peripheral surface of the closure first flange adapted to threadably engage the threads of the container neck;

the closure having a second generally cylindrical flange of a diameter larger than the diameter of the container neck by an amount at least equal to twice the distance by which the locking lug projects radially from the container neck;

at least one lug engagement finger projecting generally radially inwardly from the second closure flange, the engagement finger being adapted to abut the locking lug when the closure is threaded in place over the container neck;

means for resiliently mounting the engagement finger to the second closure flange; and, means associated with the resilient mounting means for selectively displacing the finger out of abutment with the locking finger thereby allowing the closure to be unthreaded from the container neck.

2. The safety closure and container of claim 1, wherein the finger displacing means comprises lever means associated with the finger, the lever means extending outwardly of the second closure flange.

3. The safety closure and container of claim 1, wherein the locking lug comprises a cam surface adapted to contact the finger as the closure is being threaded downwardly over the container neck to resiliently displace the finger.

4. The safety closure and container of claim 1, wherein the resilient mounting means provides for resilient displacement of the finger in a direction generally perpendicularly to the plane of the locking lug.

5. The safety closure and container of claim 1, the depth of the second flange is greater than the distance from the free edge of the container neck to the bottom side of the locking lug.

6. The safety closure and container of claim 1, wherein:

the locking lug extends from the container neck by a distance greater than one half the radial distance between the container neck and closure second flange when the closure is in place over the container neck; and, the finger extends from the second flange by a distance greater than one half of the radial distance between the container neck and the closure is in place over the container neck.

7. A safety closure and container, the safety closure for sealingly closing the opening into the container, comprising:

the container having a generally cylindrical neck defining the opening into the container;

threads formed in the outer peripheral surface of the container neck;

at least two locking lugs projecting generally radially outwardly from the container neck, the locking lugs being located below the threads on the container neck, and the lugs being spaced apart from each other circumferentially of the container neck;

the closure having a first generally cylindrical flange of a diameter larger than the diameter of the container neck;

threads formed in the inner peripheral surface of the closure first flange adapted to threadably engage the threads of the container neck;

the closure having a second generally cylindrical flange of a diameter larger than the diameter of the container neck by an amount at least equal to twice the distance by which a locking lug projects radially from the container neck;

at least two lug engagement fingers projecting generally radially inwardly from the second closure flange, the engagement fingers being spaced apart from each other circumferentially of the second closure flange by an arc substantially equal to the arc separating the spaced apart locking lugs about the circumference of the container neck, each of the engagement fingers being adapted to abut a different one of the locking lugs when the closure is threaded in place over the container neck;

means for resiliently mounting the engagement fingers to the second closure flange; and, means associated with the resilient mounting means for selectively displacing the fingers out of abutment with the locking lugs thereby allowing the closure to be unthreaded from the container neck.

8. The safety closure and container of claim 7, wherein the finger resilient mounting means comprises a resilient strap interconnecting the fingers, the resilient strap being affixed to the inner peripheral surface of the second cylindrical flange.

9. The safety closure and container of claim 7, wherein the finger displacing means comprises lever means associated with the fingers, the lever means extending generally radially outwardly of the second cylindrical flange.

10. The safety closure and container of claim 7, wherein:

each of the two locking lugs project a predetermined distance;

each of the two fingers project a predetermined distance sufficient to overlap at least a portion of a locking lug when the closure is threaded in place over the container neck.

11. The safety closure and container of claim 7, wherein:

the two locking lugs are located in generally diametric opposition about the circumference of the container neck; and, the two fingers are located in generally diametric opposition about the circumference of the second cylindrical flange of the closure.

12. The safety closure and container of claim 7, wherein the first and second cylindrical flanges are concentric.

13. The safety closure and container of claim 7, wherein:

each of the locking lugs extend from the container neck by a distance greater than one half the radial distance between the container neck and closure second flange when the closure is in place over the container neck; and, each of the fingers extend from the second flange by a distance greater than one half of the radial distance between the container neck and the closure second flange when the closure is in place over the container neck.

14. The safety closure and container of claim 7, wherein:

the second closure flange is formed with two slits spaced apart circumferentially of the second flange;

the finger resilient mounting means comprises a resilient strap interconnecting the fingers, the resilient strap being affixed to the inner peripheral surface of the second flange in a zone of the second flange between the slits; and, the finger displacing means comprises two levers associated with the strap means and extending generally radially outwardly of the second flange, each lever projecting through a different one of the slits.

15. The safety closure and container of claim 7, wherein each locking lug comprises a cam surface adapted to contact the fingers as the closure is being threaded downwardly over the container neck to resiliently displace the fingers.

16. The safety closure and container of claim 7, wherein the depth of the second flange is greater than the distance from the free edge of the container neck to the bottom side of the locking lugs.

17. The safety closure and container of claim 7, wherein the resilient mounting means provides for resilient displacement of the fingers in a direction generally perpendicular to the plane of the locking lugs.

18. The safety closure and container of claim 7, wherein the locking lugs are integrally formed with the container neck.

19. The safety closure and container of claim 7, wherein:

the two locking lugs are spaced apart circumferentially of the container neck by an arc of about 180 degrees;

the two fingers are spaced apart circumferentially of the second flange by an arc less than 180 degrees.

* * * * *